US008672167B2

(12) United States Patent
Leuenberger et al.

(10) Patent No.: US 8,672,167 B2
(45) Date of Patent: Mar. 18, 2014

(54) SELF-OPENING AND RE-SEALABLE POURING ELEMENT OF PLASTICS MATERIAL FOR APPLICATION TO A PACK FOR LIQUIDS

(75) Inventors: Markus Leuenberger, Thayngen (CH); Markus Wassum, Schaffhausen (CH)

(73) Assignee: SIG Technology AG, Neuhausen am Rheinfall (CH)

( * ) Notice: Subject to any disclaimer, the term of this patent is extended or adjusted under 35 U.S.C. 154(b) by 468 days.

(21) Appl. No.: 12/745,353

(22) PCT Filed: Nov. 28, 2008

(86) PCT No.: PCT/EP2008/066471

§ 371 (c)(1), (2), (4) Date: Aug. 23, 2010

(87) PCT Pub. No.: WO2009/068671

PCT Pub. Date: Jun. 4, 2009

(65) Prior Publication Data

US 2010/0320209 A1 Dec. 23, 2010

(30) Foreign Application Priority Data

Nov. 29, 2007 (DE) ..... 10 2007 057 863

(51) Int. Cl.
*B65D 17/52* (2006.01)

(52) U.S. Cl.
USPC ..... 220/284; 220/267; 222/541.2

(58) Field of Classification Search
USPC ..... 220/284, 200, 236, 203.08, 267; 222/83, 91, 541.2; 215/250, 253, 252
See application file for complete search history.

(56) References Cited

U.S. PATENT DOCUMENTS

| | | | | |
|---|---|---|---|---|
| 4,548,332 | A | 10/1985 | Neat | |
| 5,228,592 | A * | 7/1993 | Pellerano | 222/83 |
| 5,482,176 | A | 1/1996 | Maietta et al. | |
| 6,398,075 | B1 * | 6/2002 | Laciacera et al. | 222/91 |
| 7,458,486 | B2 * | 12/2008 | Weist et al. | 222/83 |
| 7,611,025 | B2 * | 11/2009 | Nusbaum et al. | 215/253 |
| 7,810,663 | B2 * | 10/2010 | Young | 215/253 |
| 2005/0242113 | A1 * | 11/2005 | Weist | 222/83.5 |
| 2008/0210745 | A1 | 9/2008 | Rigling | |
| 2009/0250488 | A1 | 10/2009 | Dubach | |
| 2009/0302037 | A1 * | 12/2009 | Rigling | 220/258.4 |

FOREIGN PATENT DOCUMENTS

| | | | |
|---|---|---|---|
| DE | 699 03 815 | T2 | 2/2003 |
| DE | 10 2006 016 113 | B3 | 8/2007 |
| EP | 0 385 603 | A1 | 9/1990 |
| EP | 1 088 764 | A1 | 4/2001 |

(Continued)

*Primary Examiner* — Luan K Bui
*Assistant Examiner* — Rafael Ortiz
(74) *Attorney, Agent, or Firm* — The Webb Law Firm

(57) ABSTRACT

A self-opening and re-sealable pouring element of plastics material for application to a pack for liquids, and in particular a composite card/plastics material pack, has a base part which has an attaching flange, having a cutting element and a screw cap, the cutting element being rotatably arranged in the interior of the base part and operatively connected to the screw cap such that when the screw cap is unscrewed for the first time, an opening for pouring is produced by the cutting element in the material of the pack, wherein, when produced in an injection mold, the cutting element is already entirely arranged in the interior of the base part and is spaced away from the base part by a plurality of connecting bridges.

17 Claims, 4 Drawing Sheets

(56) References Cited

FOREIGN PATENT DOCUMENTS

| | | | |
|---|---|---|---|
| EP | 1 509 456 | A1 | 3/2005 |
| FR | 2 779 127 | A1 | 12/1999 |
| FR | 2 779 418 | A1 | 12/1999 |
| WO | 98/14317 | A1 | 4/1998 |
| WO | 9962775 | A1 | 12/1999 |
| WO | 03/101843 | A1 | 12/2003 |
| WO | 03101843 | A1 | 12/2003 |
| WO | 2006/089440 | A1 | 8/2006 |
| WO | 2007/051328 | A1 | 5/2007 |

* cited by examiner

SELF-OPENING AND RE-SEALABLE POURING ELEMENT OF PLASTICS MATERIAL FOR APPLICATION TO A PACK FOR LIQUIDS

BACKGROUND OF THE INVENTION

1. Field of the Invention

The invention relates to a self-opening and re-sealable pouring element of plastics material for application to a pack for liquids, and in particular a composite card/plastics material pack, having a base part which has an attaching flange, having a cutting element and having a screw cap, the cutting element being rotatably arranged in the interior of the base part and being operatively connected to the screw cap in such a way that, when the screw cap is unscrewed for the first time, an opening for pouring is produced by the cutting element in the material of the pack.

2. Description of the Related Art

Self-opening and re-sealable pouring elements of the kind specified above are known in practice in a wide variety of versions. The pouring elements which are proving more and more popular in this case are ones which have a screw cap which, when unscrewed for the first time, causes a cutting element, by means of members providing positive guidance, to make a pouring opening in the composite material which was previously entirely tightly sealed. The known pouring element of the generic kind is therefore in three parts: a base part, a cutting element and a screw cap.

Known from U.S. Pat. No. 5,482,176 is a pouring element in three parts in the case of which all three of the parts have to be produced separately and then assembled to one another. To do this, the cutting element is screwed into the base part and in a second step the screw cap is thumped onto the base part. Assembly of this kind is relatively costly and complicated.

To simplify the assembly of known pouring elements of this kind, it has already been proposed (EP 1 088 764 B1) that the base part be injection moulded in one piece with the cutting element, this being accomplished by arranging the cutting element, by means of connecting bridges, in a spaced-away position below the floor of the base part which has the attaching flange. For the two parts to be assembled to one another, the only other thing which has to be done is for them to be screwed into one another.

In the case of another known pouring element (EP 0 385 603 A1), the base part and cutting element are likewise produced in one piece as an preformed assembly, but the connecting bridges which connect the two parts together are not broken until the time of first opening by the consumer.

Taking the above as a point of departure, the object underlying the invention is to design and refine the three-piece pouring element which was specified in the opening paragraph and has been described above in such a way that particularly simple and hence inexpensive production becomes possible. Easy assembly is also desired.

SUMMARY OF THE INVENTION

In the case of a self-opening and re-sealable pouring element as defined in the preamble to claim 1, this object is achieved by virtue of the fact that, when produced in an injection mould, the cutting element is already entirely arranged in the interior of the base part and is spaced away from the base part by a plurality of connecting bridges.

In accordance with the invention, it has been appreciated that plugging or screwing together of the base part and cutting element can be dispensed with if the two parts are already in the fitted-together state when injection moulded. Because of the special design of the pouring element according to the invention, it is possible to use a mould not having any sliders, whereby the production costs and times can be considerably reduced. Because there are no sliding components present in the injection mould, the space available is able to accommodate a larger number of cavities, thus making it possible for more efficient use to be made of the injection mould.

In accordance with further teaching of the invention, provision is made for the base part to have a plurality of guiding ridges which are arranged in a distributed manner on its inner wall and whose gradient varies, and the cutting element has a plurality of guiding tongues which are arranged in a correspondingly distributed manner on its outer wall, thus causing rotation of the cutting element in the interior of the base part first to take place along a steep helical line and then along a shallow helical line. This special arrangement of the guiding ridges and tongues ensures that there are no overlapping internal parts present within the pouring element, which means that, as mentioned, sliders can be entirely dispensed with in the injection mould. Guidance of this kind between the cutting element and base part is already known per se from European patent EP 1 509 456 B1, which originated from the present applicant.

For this purpose, the cutting element preferably has, for each guiding ridge on the base part, an upper guiding tongue and a lower guiding tongue, to enable the cutting element to be positively guided respectively above and below the given guiding ridge. It has been found that it is not necessary for portions of thread which correspond to one another to be produced given that adequate positive guidance is already ensured simply by the use of short guiding tongues.

In a further embodiment of the invention, provision is made for at least some of the radial guiding tongues to be intended to act at the same time as abutments for lugs, acting as force-transmitting members, which project into the interior of the base part from the screw cap and which are arranged on a concentric circular line. It is admittedly also conceivable for the lugs arranged in the screw cap to be provided in the interior of the cutting element but this is a disadvantage on the one hand because of the poorer lever action, but it also has an adverse effect on behaviour at the time of pouring because corresponding members for entrainment would have to be arranged in the interior of the cutting element and in this way would constrict the clear cross-section for pouring.

Sufficiently steady guidance is obtained between the base part and the cutting element if the base part has three guiding ridges and the cutting element, accordingly, also has three groups of guiding tongues. Nevertheless, pouring elements which have more than three pairs of guiding means also fall within the scope of the invention.

In another, particularly useful, embodiment of the invention, provision is made for the guiding ridges to have recesses at their bottom ends to receive the upper guiding tongues and for the upper guiding tongues to be positively guided into these recesses when the screw cap is unscrewed for the first time. For this purpose, the lugs in the screw cap may be suitably configured at their ends to cause the upper guiding tongues always to be pressed into the recesses when the screw cap is re-sealed (screwed closed).

Other teaching according to the invention makes provision for the connecting bridges to be arranged between the lower radial guiding tongues on the cutting element and the inner wall of the base part, they being arranged preferably between the lower radial guiding tongues and the inner wall of the base part. Because the lower guiding tongues are situated below the guiding ridges when the cutting element is twisted into the composite material, the remains of the connecting bridges are not able to adversely affect the opening process.

It is particularly useful for the lower radial guiding tongues to be arranged in an inclined position and for the inclination to substantially correspond to the mean gradient of the guiding ridges on the base part. By virtue of a configuration of this kind, the cutting element slides along the guiding ridges in a particularly elegant way in the course of the twisting into the composite material caused by the unscrewing of the screw cap and in this way make the opening process easier.

A further embodiment of the invention makes provision for the connecting bridges to be broken by the consumer at the first time of opening. It is however also possible for the connecting bridges to be broken when the screw cap is pressed or screwed onto the base part. It is for example conceivable in this case for the assembly comprising the cutting element and base part which are produced in one piece to be twisted relative to one another by a slight screwing-closed movement after the cap has been put on, thus pulling the connecting bridges apart.

In a further embodiment of the invention, provision is made for the screw cap to be produced in one piece with the base part and the cutting element by means of at least one connecting web. A design of this kind is particularly useful because the complete pouring element can be produced in a single mould. In a further embodiment, the connecting web may, at the same time, act in this case as a tamper-evidencing seal. For this purpose the connecting web usefully has an intended point of fracture in order not to make the opening process more difficult.

The length of the connecting web should preferably be so sized that, in the production process in the injection mould, the screw cap is injected onto the attaching flange in an open, folded-open position and, for final assembly, the screw cap is pivoted over the base part and pressed together therewith. A design of this kind is already known per se and has been previously described in U.S. Pat. No. 4,548,332.

It is however also conceivable within the scope of the invention for the screw cap to be produced separately from the base part and the cutting element. In a case like this, after the screw cap is pressed onto the base part, a connection which can be discerned by the consumer and which is broken at the time of first opening is applied to act as a tamper-evidencing seal between the base part and the screw cap. In this way, it can always be seen by the consumer whether or not the pouring element has already been opened once.

BRIEF DESCRIPTION OF THE DRAWINGS

The invention will be explained in detail below by reference to the drawings, which merely show one preferred embodiment. In the drawings:

FIG. 3 is a perspective view of the pouring element shown in FIGS. 1 and 2, when fully assembled with the screw cap pressed on.

Figure 1:
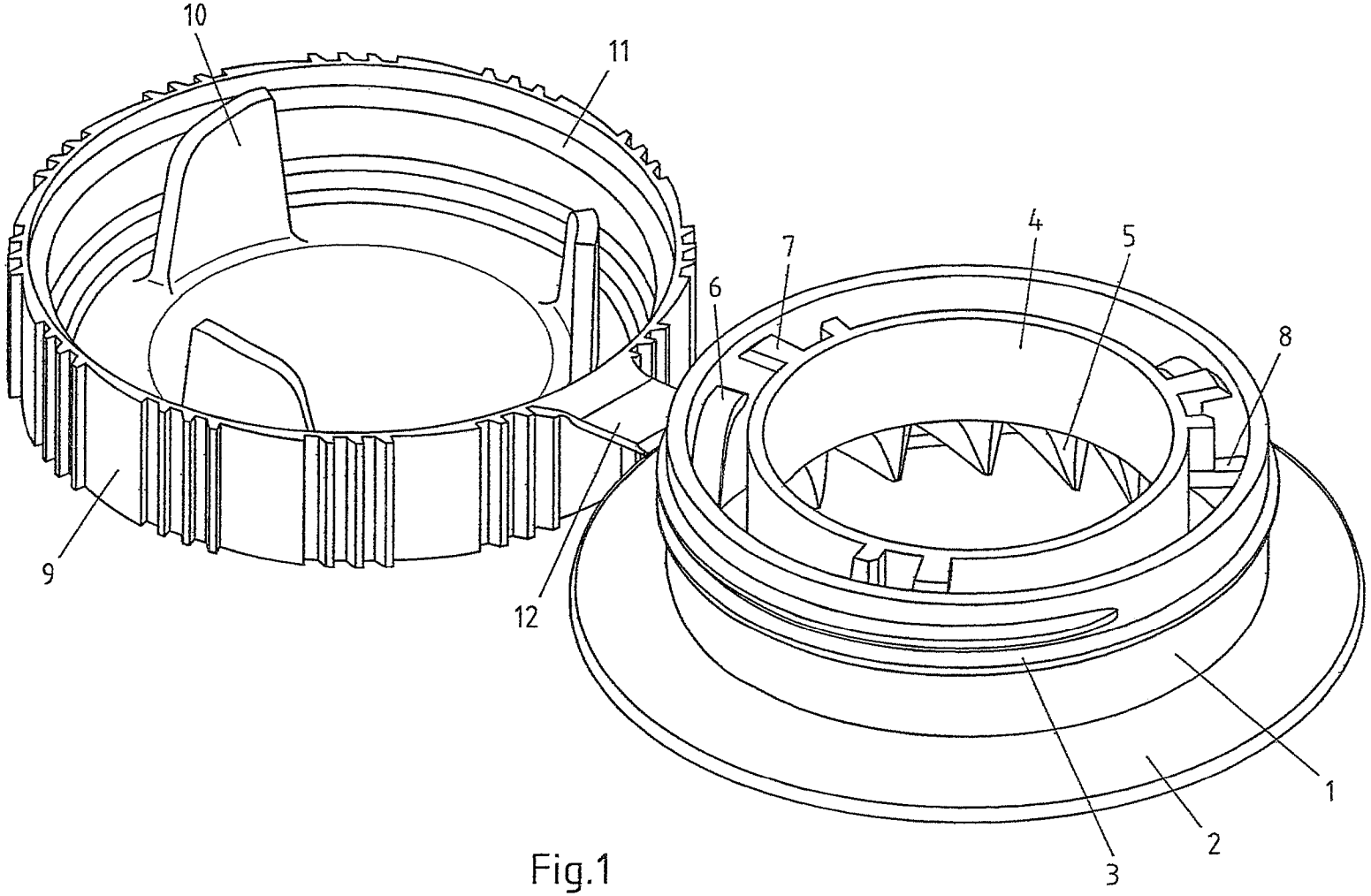
FIG. 1 is a perspective view of a pouring element according to the invention after removal from the injection mould.

The pouring element can be seen in FIG. 1 in the position in which it is removed from the injection mould. The pouring element has, initially, in this case a base part 1 which has a circumferential attaching flange 2 and an outside thread 3. Situated in the interior of the base part 1 is a cutting element 4 which is provided on its underside with a plurality of teeth. The positive guidance between the base part 1 and the cutting element 4 is provided on the one hand by guiding ridges 6 which are arranged in the interior of the base part 1, which is in the form of a hollow cylinder, and also by guiding tongues 7 and 8 which are arranged on the outside of the cutting element 4 and which will be considered in detail later on.

DETAILED DESCRIPTION OF THE PREFERRED EMBODIMENTS

The pouring element is sealed by a screw cap 9 which has in its interior lugs 10 which are arranged on a concentric circular line and which serve as force-transmitting members to operate (turn) the cutting element 4 at the time of first unscrewing, for which purpose the steep edge-face of each lug 10 presses against each guiding tongue 8. On its inside, the screw cap 9 has an inside thread 11 which corresponds to the outside thread 3 on the base part but is of a larger pitch.

In the embodiment which is shown and is thus preferred, the base part 1 and the screw cap 9 are connected together by means of a connecting web 12. The connecting web 12 is arranged between the edge of the screw cap 9 and the attaching flange 2 of the pouring element and is of a length which makes it possible for the screw cap 9 to be pivoted over and pressed onto the base part 1.

Figure 2:
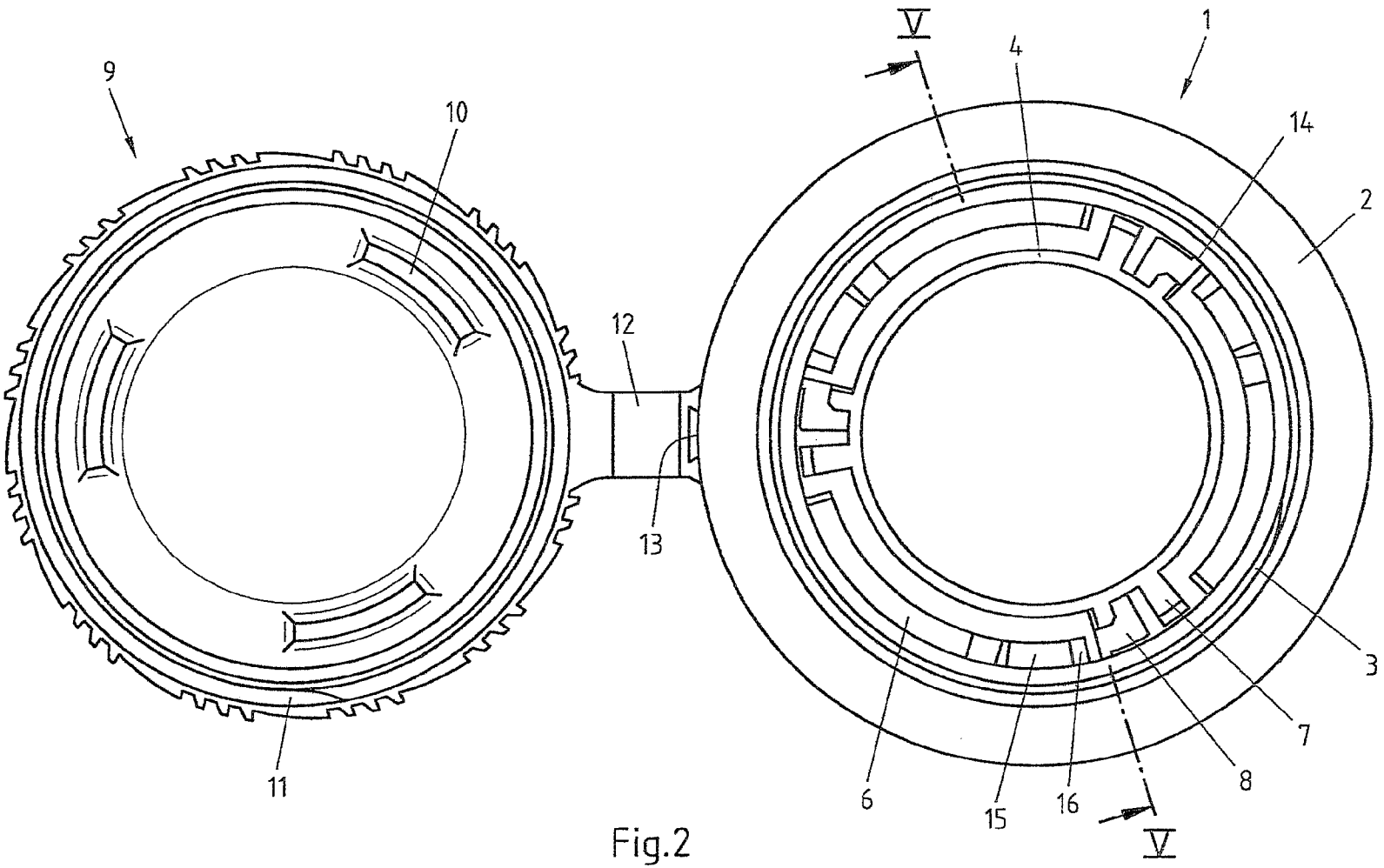
FIG. 2 is a plan view of the pouring element shown in FIG. 1.

In the plan view in FIG. 2, it can also be seen that the connecting web 12 has an intended point of fracture 13 towards the attaching flange 2, that is to say is connected to the attaching flange 2 at the point in question only by two narrow connecting bridges which are not specifically identified. The connection between the base part 1 and the cutting element 4 is made in this case by means of connecting bridges 14, the arrangement of which will be described in detail at a later stage.

Figure 3:
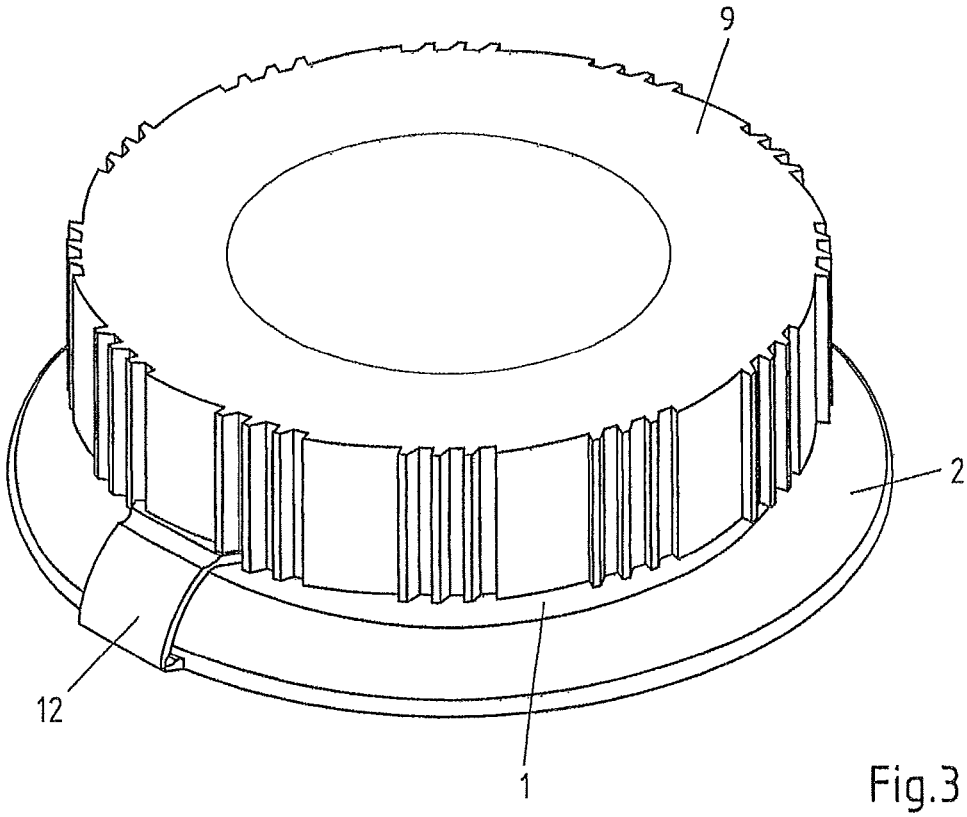

FIG. 3 shows a fully assembled pouring element and it can clearly be seen that the connecting web 12 gives a direct indication to the consumer of whether or not the screw cap has already been opened once. It therefore acts as a tamper-evidencing seal.

Figure 4:
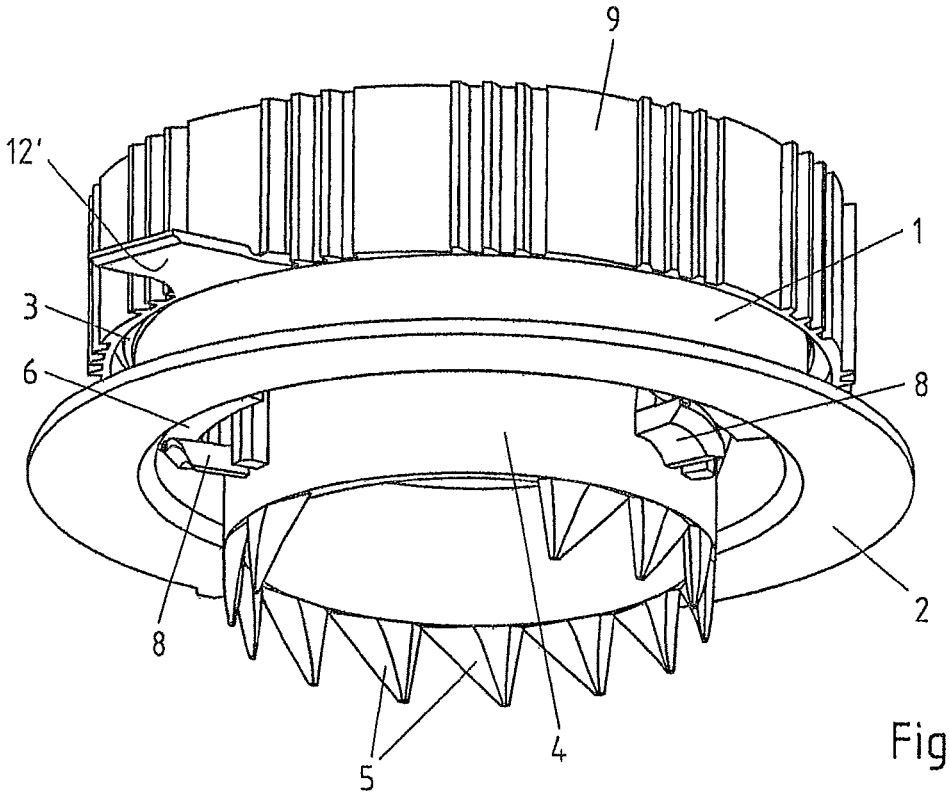
FIG. 4 is a perspective view from below showing the pouring element once the screw cap has been operated.

The pouring element according to the invention is shown in FIG. 4 in a position which shows the individual components after the screw cap 9 has been screwed on. The cutting element 4 has in this case traveled along the guiding ridges 6 and penetrated into the composite material situated below the attaching flange 2 and in so doing has performed approximately a quarter of a revolution. It can clearly be seen that the connecting web 12 has pulled apart and that the projecting end 12' has come free from the attaching flange 2. It can also be seen that the cutting element 4 does not have teeth at all points on its bottom end, but that in a certain region it dispenses with the provision of teeth, to ensure that the piece of composite material which is cut loose does not detach from the rest of the composite material, the aim being to ensure that it cannot under any circumstances come free from the composite pack and find its way into the consumer's drink. Because the cutting element 4 now projects into the interior of the pack in a tubular form, the piece of composite material which has been partly punched out will tend more to be bent downwards, thus enabling the opening for pouring always to remain of its full cross-section.

Figure 5:
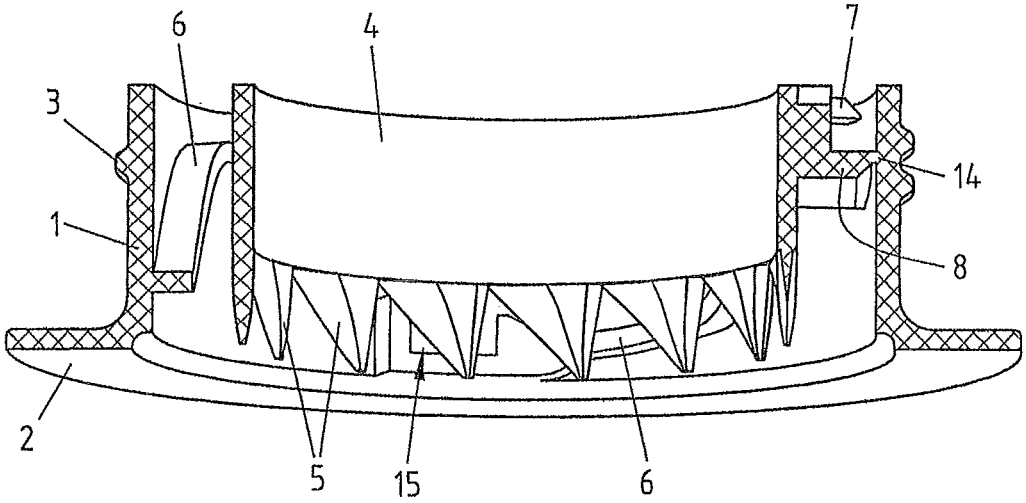
FIG. 5 is a perspective view from below showing the base part and cutting element in vertical section on line V-V in FIG. 2.
Figure 6:
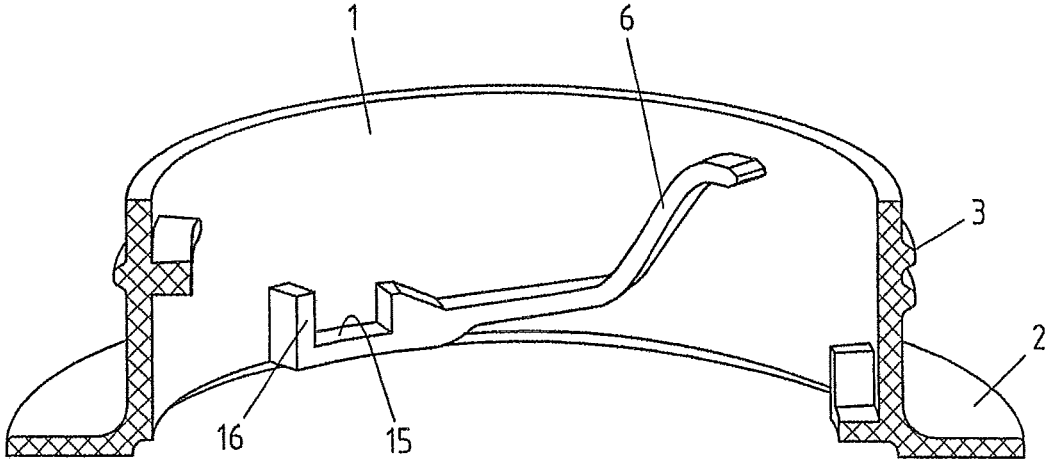
FIG. 6 is a perspective view showing a single base part in vertical section

What is then again shown in FIG. 5, in vertical section, is the unit assembly comprising the base part 1 and cutting element 4, to enable the precise preferred position of the connecting bridges 14 to be explained. These latter are situated between the outer ends of the lower guiding tongues 18 and the inner wall of the base part 1. Because the precise configuration of the guiding ridges 6 is concealed in this case by the cutting element 4, a base part 1 is again shown in section in FIG. 6, but with the cutting element 4 omitted. It can be seen in this case that the guiding ridge 6, looked at from the top downwards, is first of a relatively steep form and then ends up being relatively shallow. This causes a rotation of the cutting element 4 in the interior of the base part 1 to take place first along a steep helical line and then along a shallow one. For the opening process, what this means is that the teeth first punch their way into (stab) the composite material, or a PE film covering an opening in the card, and then make a circular movement at a shallow angle (cutting). So that the cutting element 4 will then remain in its end position, provision is made, in accordance with further teaching of the invention, for the guiding ridges 6 to have, at their bottom ends, a recess 15 in which the upper guiding tongues 7 are an exact fit, which means that they are locked there by a stop 16. This positive guidance too is caused by the lugs 10 on the screw cap 9. Where the top face of the ridge 16 rises again shortly before the recess 15 is reached, the purpose of this is to lock the upper guiding tongues 7 reliably. This rise is shown in a somewhat exaggerated form in FIG. 6 to make the principle clear.

The invention claimed is:

1. A self-opening and re-sealable pouring element of plastics material for application to a pack for liquids, comprising (1) a base part, the base part having a hollow interior and an inner wall, a first end and an opposite second end, and the first end having an attaching flange, (2) a cutting element, the cutting element having an outer wall, and a first end and an opposite second end, and (3) a screw cap, the cutting element being arranged in the interior of the base part and being operatively connected to the screw cap in such a way that, when the screw cap is unscrewed for the first time, the cutting element is rotated around a vertical axis to screw the cutting element into the material of the pack to produce an opening for pouring, wherein the base part and cutting element are produced by an injection mould, the cutting element is entirely arranged in the interior of the base part such that the first end and the second end of the cutting element are within and between the first end and the second end of the base part and the outer wall of the cutting element is spaced away from the inner wall of the base part and portions of the outer wall of the cutting element are joined to portions of the inner wall of the base part by a plurality of connecting bridges, wherein the connecting bridges are broken when the screw cap is pressed or screwed onto the base part.

2. The pouring element according to claim 1, wherein the pack for liquids comprises a composite card/plastics material pack.

3. The pouring element according to claim 1, wherein the base part has a plurality of guiding ridges which are arranged in a distributed manner on its inner wall and whose gradient varies, and the cutting element has a plurality of guiding tongues which are arranged in a correspondingly distributed manner on its outer wall, thus causing rotation of the cutting element in the interior of the base part first to take place along a steep helical line and then along a shallow helical line.

4. The pouring element according to claim 3, wherein, for each guiding ridge on the base part, the cutting element has an upper guiding tongue and a lower guiding tongue, to enable the cutting element to be positively guided respectively above and below a given guiding ridge.

5. The pouring element according to claim 3, wherein at least some of the radial guiding tongues are intended to act at the same time as abutments for lugs, acting as force-transmitting members, which project into the interior of the base part from the screw cap and which are arranged on a concentric circular line.

6. The pouring element according to claim 3, wherein the base part has three guiding ridges and the cutting element, accordingly, also has three groups of guiding tongues.

7. The pouring element according to claim 4, wherein the guiding ridges have recesses at their bottom ends to receive the upper guiding tongues, and in that the upper guiding tongues are positively guided into these recesses when the screw cap is unscrewed for the first time.

8. The pouring element according to claim 3, wherein the connecting bridges are arranged between the radial guiding tongues on the cutting element and the inner wall of the base part.

9. The pouring element according to claim 4, wherein the connecting bridges are arranged between the lower radial guiding tongues on the cutting element and the inner wall of the base part.

10. The pouring element according to claim 4, wherein the lower radial guiding tongues are arranged in an inclined position and in that the inclination substantially corresponds to the mean gradient of the guiding ridges on the base part.

11. The pouring element according to claim 1, wherein the connecting bridges are broken by the consumer at the first time of opening.

12. The pouring element according to claim 1, further comprising at least one connecting web, wherein the screw cap is produced in one piece with the base part and the cutting element by means of the at least one connecting web.

13. The pouring element according to claim 12, wherein the connecting web is provided between the screw cap and the base part to act at the same time as a tamper-evidencing seal.

14. The pouring element according to claim 12, wherein the connecting web has an intended point of fracture.

15. The pouring element according to claim 12, wherein the length of the connecting web is so sized that, in the production process in the injection mould, the screw cap is injected onto the attaching flange in an open, folded-open position, and in that, for final assembly, the screw cap is pivoted over the base part and pressed together therewith.

16. The pouring element according to claim 1, wherein the screw cap is produced separately from the base part and the cutting element.

17. The pouring element according to claim 16, further comprising a connection, wherein after the screw cap is pressed onto the base part, the connection which can be discerned by the consumer and which breaks at the time of first opening is applied to act as a tamper-evidencing seal.

* * * * *

UNITED STATES PATENT AND TRADEMARK OFFICE

CERTIFICATE OF CORRECTION

PATENT NO. : 8,672,167 B2
APPLICATION NO. : 12/745353
DATED : March 18, 2014
INVENTOR(S) : Leuenberger et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 553 days.

Signed and Sealed this
Twenty-ninth Day of September, 2015

Michelle K. Lee

Michelle K. Lee
*Director of the United States Patent and Trademark Office*